US009351898B2

(12) United States Patent
Triolo et al.

(10) Patent No.: US 9,351,898 B2
(45) Date of Patent: May 31, 2016

(54) VERTICAL LIFT WALKER FOR SIT TO STAND TRANSITION ASSISTANCE

(71) Applicant: The United States of America, as Represented by the Department of Veterans Affairs, Washington, DC (US)

(72) Inventors: Ronald J. Triolo, Cleveland Heights, OH (US); Thomas C. Bulea, Cleveland, OH (US)

(73) Assignees: The United States of America, as Represnted by the Dept. of Veterans Affairs, Washington, DC (US); Case Western Reserve University, Cleveland, OH (US)

( * ) Notice: Subject to any disclaimer, the term of this patent is extended or adjusted under 35 U.S.C. 154(b) by 125 days.

(21) Appl. No.: 13/740,349

(22) Filed: Jan. 14, 2013

(65) Prior Publication Data

US 2013/0180557 A1 Jul. 18, 2013

Related U.S. Application Data

(60) Provisional application No. 61/587,695, filed on Jan. 18, 2012.

(51) Int. Cl.
*A61G 5/14* (2006.01)
*A61H 3/00* (2006.01)
(Continued)

(52) U.S. Cl.
CPC .. *A61H 3/00* (2013.01); *A61G 5/14* (2013.01); *A61H 3/04* (2013.01); *A61G 7/1019* (2013.01); *A61G 7/1092* (2013.01); *A61G 7/1094* (2013.01); *A61H 2201/1638* (2013.01)

(58) Field of Classification Search
CPC ..... A45B 3/00; A61H 3/00; A61H 3/04; A61H 2201/5051; A61H 2201/5056; A61H 2201/14; A61H 2201/1409
USPC ..... 135/65, 66, 67
See application file for complete search history.

(56) References Cited

U.S. PATENT DOCUMENTS 5,365,621 A 11/1994 Blain
5,853,015 A * 12/1998 Evans ..... 135/67
(Continued)

FOREIGN PATENT DOCUMENTS

EP 0250415 B1 * 12/1991

OTHER PUBLICATIONS

Commercial Brochure: "Gas Springs and Dampers for Medical Technology and Rehab Applications", date/city unknown, pp. 8-11, Medizinprospekt v. 6.1, E. Einzel, provided herewith as published at: http://www.stabilus.com/applications/rehabilitation-applications/walkers-lifiting-aids.html.

*Primary Examiner* — David R Dunn
*Assistant Examiner* — Danielle Jackson
(74) *Attorney, Agent, or Firm* — Robert Gorman; Gorman Law Offices

(57) ABSTRACT

This invention relates to a lift to assist in standing and/or walking for persons who have insufficient strength or movement in their legs. The inventive lift walker includes a frame assembly having a lower an upper and lower portion that wheels are provided beneath the lower frame so as to enable the lift to be propelled and maneuvered. A bracing assembly is provided at the upper portion and comprises a supporting platform which is adapted to fit under the forearms of a person, and optional handles for gripping by the user's left and right hands. An elevator assembly is provided which includes lift and stabilization tracks for raising and lowering the supporting assembly in a coordinated, purely vertical fashion, and further includes gas lift means for effectuating the same via use of a remotely switched activation mechanism. There are also anti-tip means for maintaining the stability of the device when contacting uneven ground surface during movement.

10 Claims, 12 Drawing Sheets

(51) Int. Cl.
*A61H 3/04* (2006.01)
*A61G 7/10* (2006.01)

(56) References Cited

U.S. PATENT DOCUMENTS 6,343,802 B1 * 2/2002 Workman et al. ..... 280/87.041
6,503,176 B2 * 1/2003 Kuntz ..... 482/66
6,619,735 B1 * 9/2003 Ming-Hwa ..... 297/170
7,669,863 B2 3/2010 Steiner et al.
8,627,909 B2 * 1/2014 Chang et al. ..... 180/19.2
2006/0254631 A1 * 11/2006 Mullholand ..... 135/67
2011/0232708 A1 * 9/2011 Kemp ..... 135/67
2012/0000496 A1 * 1/2012 Razon ..... 135/67
2012/0318311 A1 * 12/2012 Alghazi ..... 135/66
2013/0098413 A1 * 4/2013 Ahlbertz et al. ..... 135/66

* cited by examiner

VERTICAL LIFT WALKER FOR SIT TO STAND TRANSITION ASSISTANCE

FIELD OF THE INVENTION

The present invention is related to the field of ambulatory assist devices, that is, lift walkers. Specifically, aspects of the invention provide a lift walker having elevator and bracing assemblies that are adapted to assist the user in rising from a seated position to a standing position or sitting from a standing position. The proposed invention therefore relates to a novel approach to improving an assistive lift walker device for restoration of independent sit-to-stand and walking functions for patients with limited lower extremity strength and motor control. More specifically, the device provides significant body weight support during the sit-to-stand transition and can support, in a stable fashion, nearly full body weight during standing and walking activities.

BACKGROUND OF THE INVENTION

Known approaches for lift walkers often incorporate mechanical springs and the like for the lift assist operation. Use of such springs for the lift assist operation is less desirable because such approaches do not offer a constant force output through the entire range of motion, a feature that is important for the stable lift assist operation of a vertical platform. Additionally, other walkers mount springs in a linkage mechanism which rotates around a stationary point in order to provide lift assistance. This is disadvantageous for two reasons. First, the cylinder line of action changes as the platform rotates around the pivot point, resulting in a variable vertical force supplied to the user. Second, the rotary motion moves the platform forward, away from the user, as it moves upward. Such motion requires the user to grip the walker platform during sit-to stand transition, a capability many spinal cord injury patients do not possess. In some cases, known walkers attempt to provide vertical platform motion something which requires a battery, electric motors and belts or straps to be used during operation, which itself offers the additional disadvantage of recharging, added weight, discomfort, inconvenience and the like.

BRIEF DESCRIPTION OF THE DRAWINGS

The subject matter which is regarded as one embodiment of the invention, is particularly pointed out and distinctly claimed in the claims at the conclusion of the specification. The foregoing and other objects, features, and advantages of the invention will be readily understood from the following detailed description of aspects of the invention taken in conjunction with the accompanying drawings in which:

SUMMARY OF THE INVENTION

Figure 1:
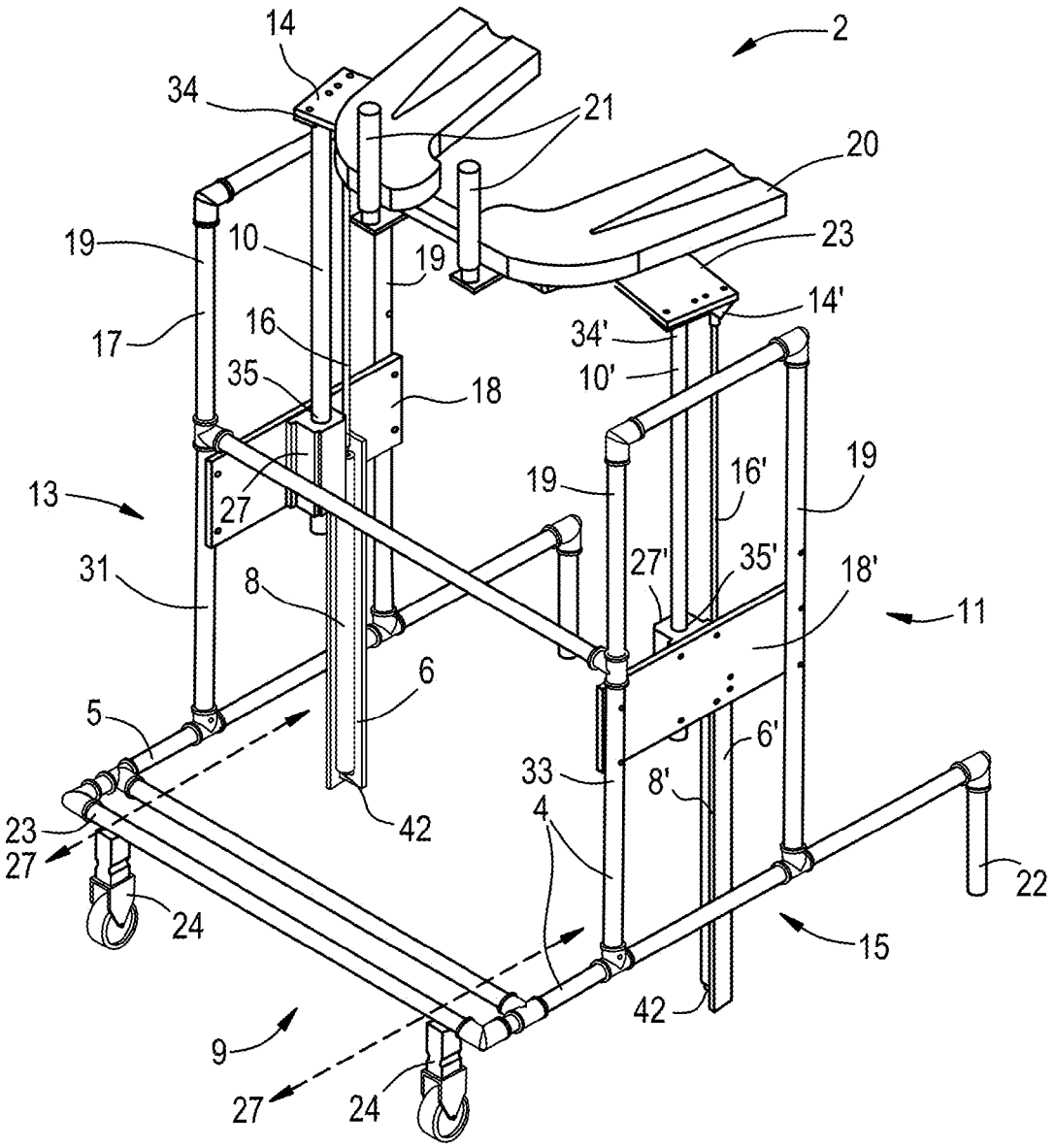
FIG. 1 is a frontal offset elevation perspective view of the inventive lift walker in an elevated or raised position according to one aspect of the present invention.
Figure 2:
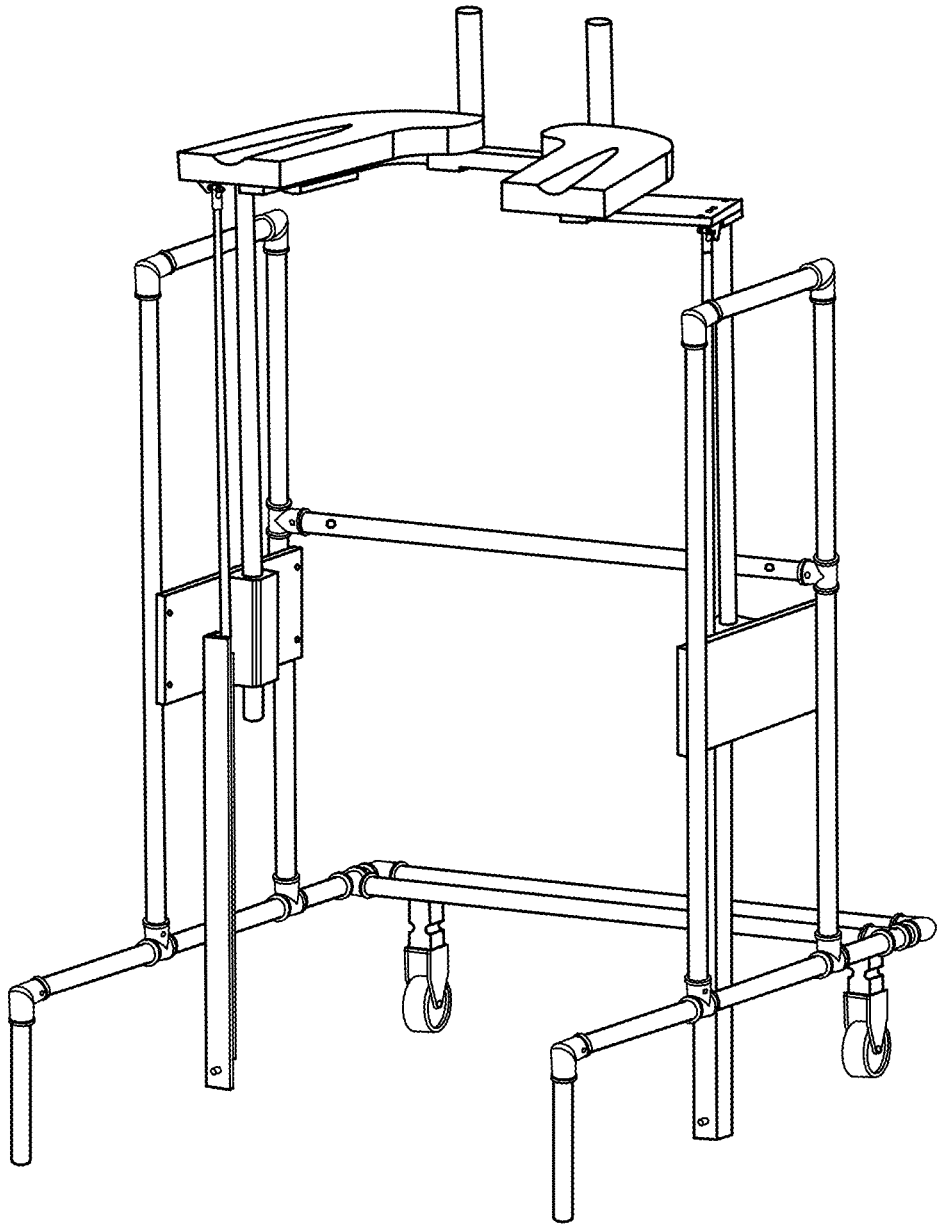
FIG. 2 is a rear offset perspective view of the walker shown in FIG. 1.
Figure 3:
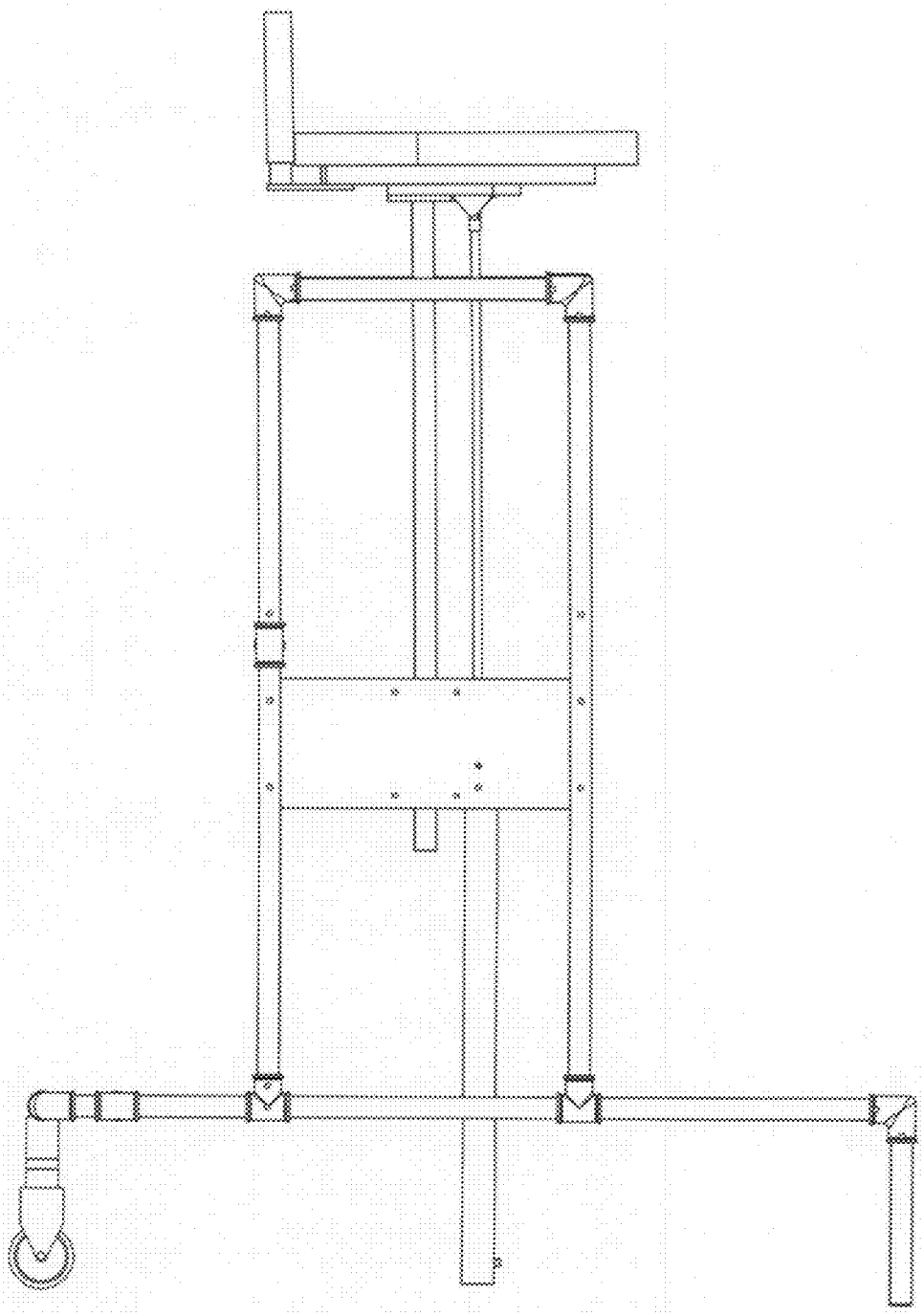
FIG. 3 is a side profile view of the walker shown in FIG. 1.
Figure 4:
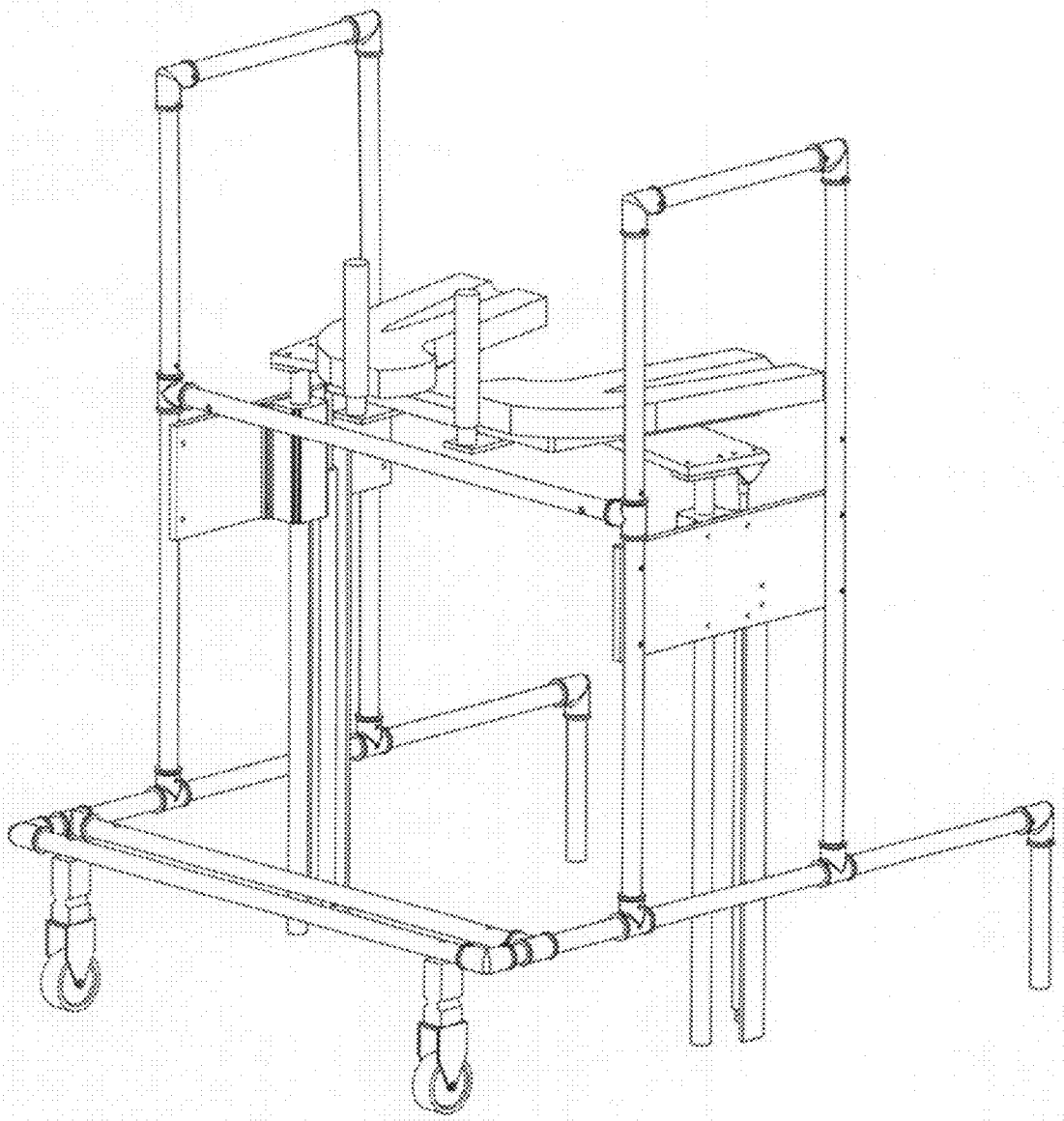
FIG. 4 is a side offset view of the walker shown in FIG. 1 in a lowered position.
Figure 5:
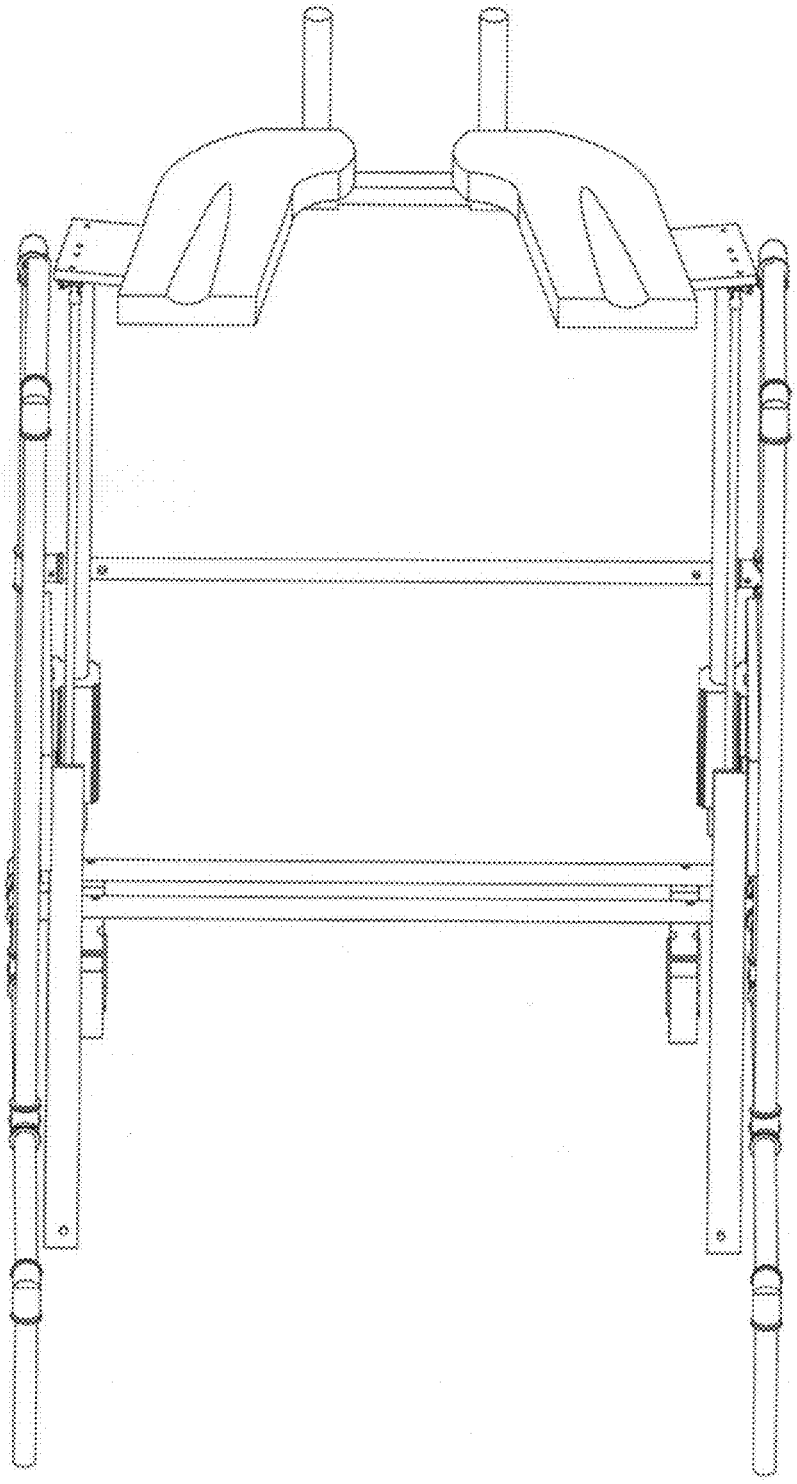
FIG. 5 is a rear profile view of the walker shown in FIG. 1.
Figure 6:
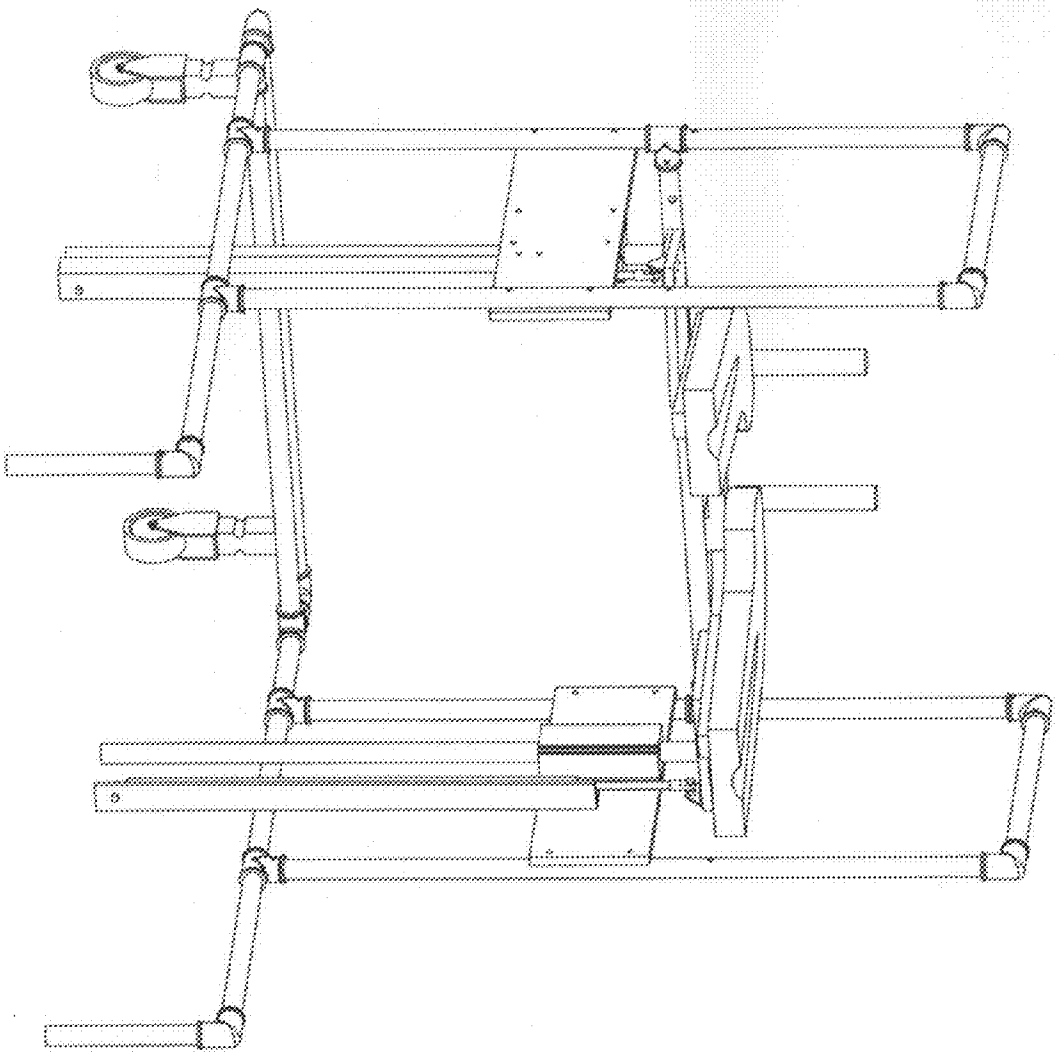
FIG. 6 is a rear offset profile view of the walker shown in FIG. 1 in a lowered position.
Figure 7:
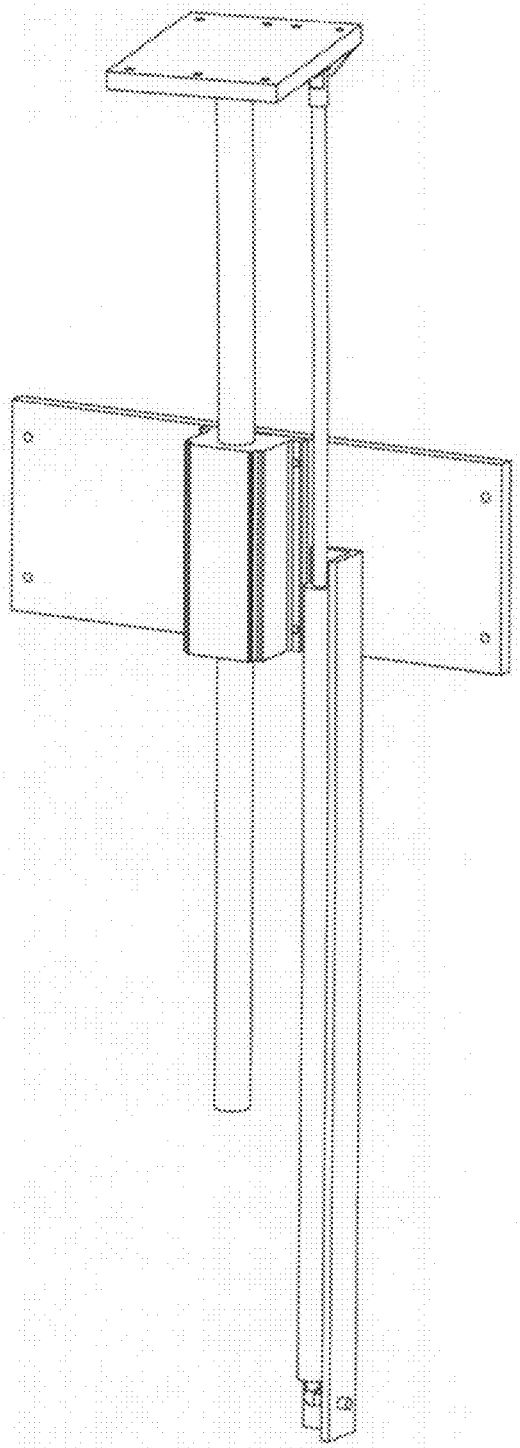
FIG. 7 is detailed cutaway view of a mechanism known as the elevator assembly that may be used in the walker shown in FIG. 1 showing one of two lift and stabilization tracks including a stabilization rod for vertical sliding engagement with a stabilization bracket through a vertical longitudinal guide hole with a self aligning linear ball bearing sleeve, and a cooperatively engaged lift rod and a vertical top end attached thereto, with the illustrated portion of the elevator assembly being in a partially raised position.
Figure 8:
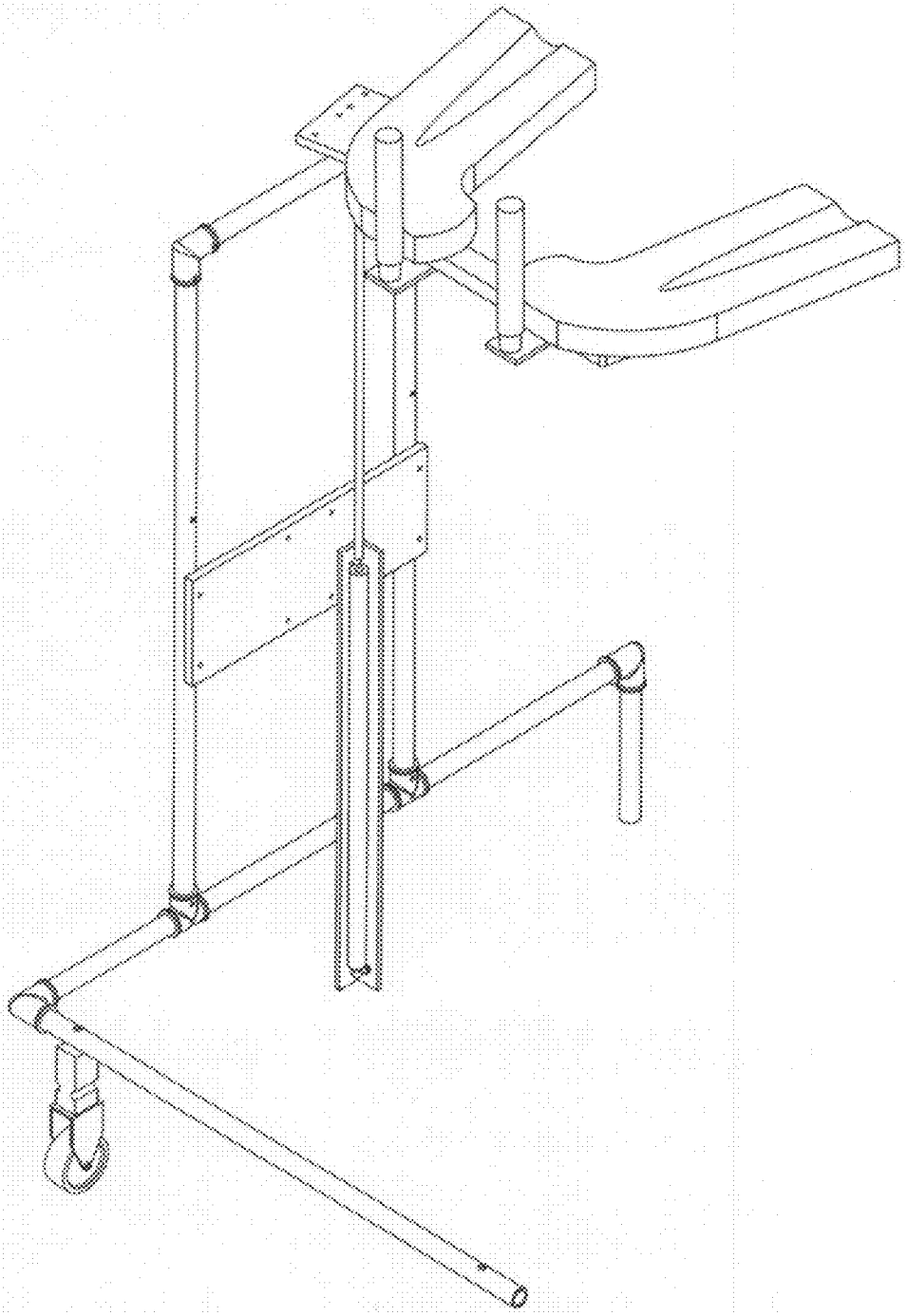
FIG. 8 is detailed cutaway view of a mechanism known as the elevator assembly that may be used in the walker shown in FIG. 1 showing one (left side) of two lift rods cooperatively engaged with the lift means (gas spring), with the illustrated portion of the elevator assembly being in a partially raised position.
Figure 9:
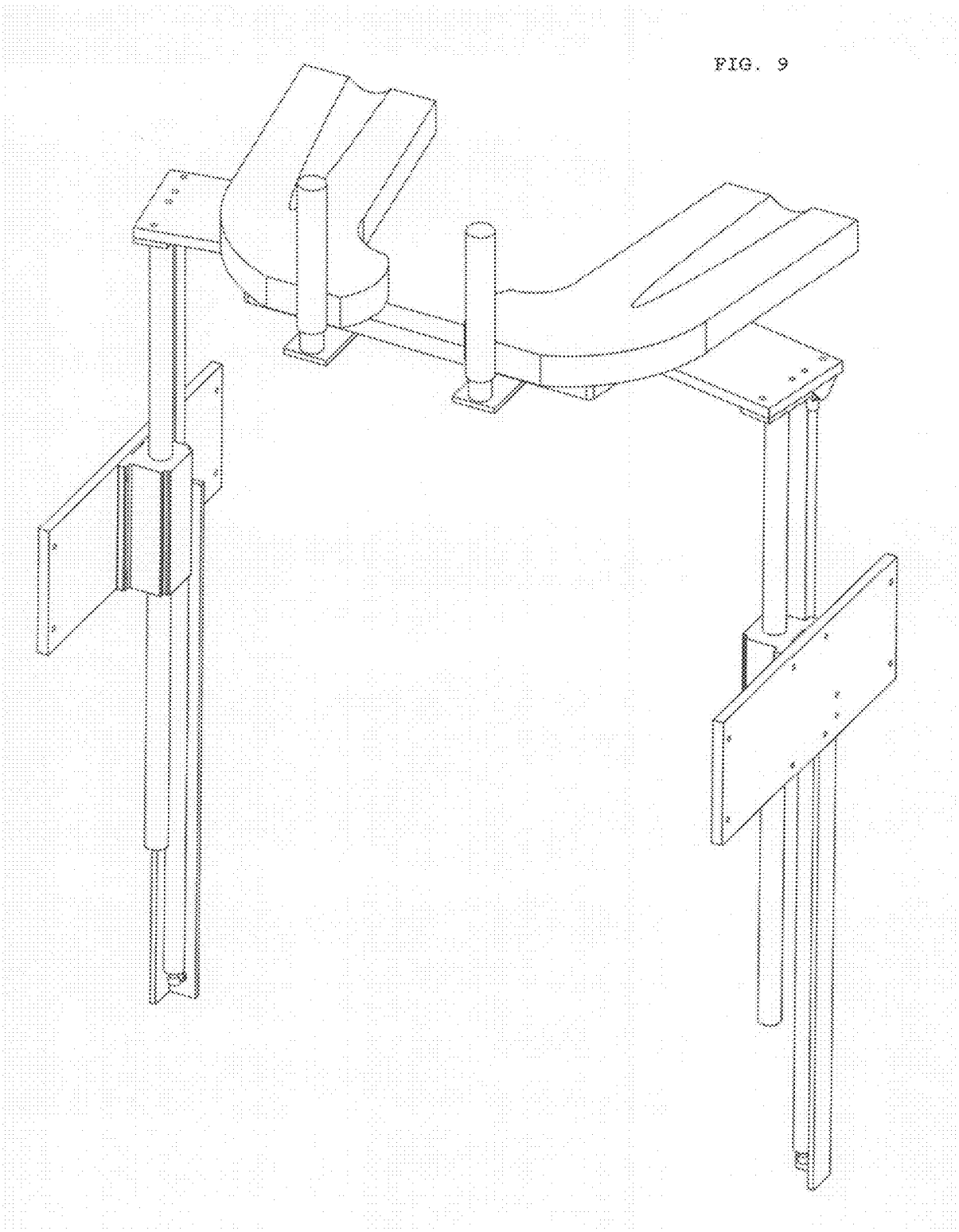
FIG. 9 is detailed cutaway view of a mechanism known as the elevator assembly that may be used in the walker shown in FIG. 1 showing both (left and right side) lift and stabilization tracks including respective stabilization rod for vertical sliding engagement with a stabilization bracket through a vertical longitudinal guide hole with a self aligned linear ball bearing sleeve, and a respective cooperatively engaged lift rods with vertical top end attached thereto for supporting a bracing assembly thereon, with the illustrated portion of the elevator assembly being in a partially raised position.
Figure 10:
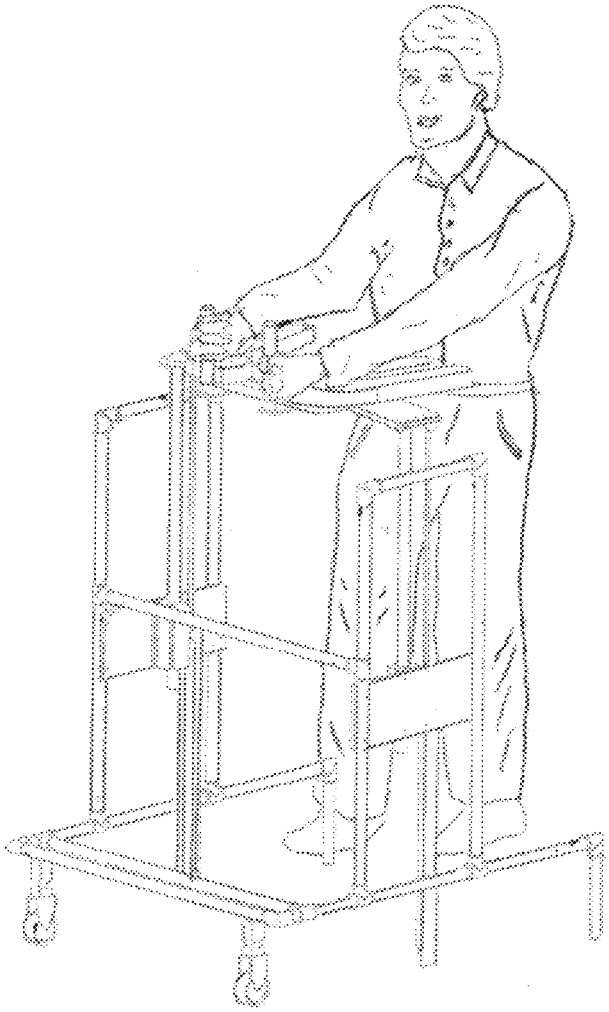
FIG. 10 is a perspective view of the lift illustrated in FIG. 1 but showing the device as illustratively used in the raised position.
Figure 11:
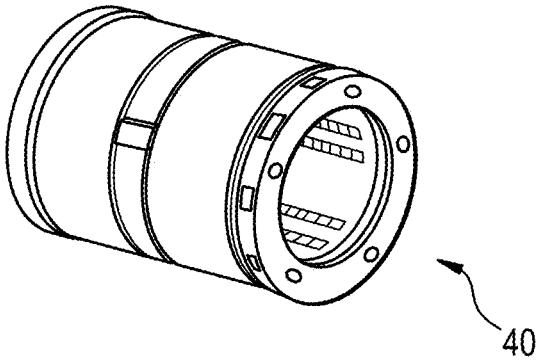
FIG. 11 is an illustrative depiction of self-aligning linear ball bearing sleeves utilized within the vertical longitudinal guide holes of the stabilization brackets of inventive device of FIG. 1.

The lift walker in accordance with this invention is extremely versatile and can assist a person to stand and/or be transferred to a sitting position in a chair, bed or bathroom, and is structured through the use of a lightweight, low cost frame that is also capable of rapid and easy assembly and disassembly. Despite this lightweight, portable structure, the inventive lift walker can assist a weak or paralyzed individual to stand for periods of time, even for heavier individuals who may require support at all times, and can do so without the need for gripping of handles, or the use of user retention harnesses. Additionally, in cases where the user has minimal use of his or her legs, the unit can be used as a walker, even by persons who cannot use a conventional walker. Furthermore, the present invention provides a lift walker which affords essentially constant force output through the entire range of (purely vertical platform) motion, without the disadvantages of rotary motion towards the user, and without the use of powered systems involving motors or batteries. To this end, the invention utilizes coordinated gas springs that are implemented in a novel way so as to create an electrical power-free lift assist walker with evenly balanced, purely vertical platform motion. As such, the invention provides for more than simple height adjustment, inasmuch as the balanced situation of the gas springs offers a pure vertical motion in a truly balanced fashion, even when under a weight-bearing strain. Such operation is especially advantageous to the spinal cord injury or geriatric populations which lack the hand function needed for gripping handles in order to maintain coupling with a walker platform. Furthermore, unlike known systems, the lift force as well as the size and range of motion of the inventive lift walker can be customized for on an individual basis, depending on the specific weight or size of a user. Also, the present invention additionally provides for anti-tip features which help avoid frontward stoppage that can tip the unit and possibly the user over the front end.

DETAILED DESCRIPTION OF THE INVENTION

At its broadest level, the present invention relates to a lift walker comprising: a frame assembly having: a lower frame assembly adapted to contact the ground; an upper frame assembly vertically affixed to the lower frame assembly; the upper frame assembly comprising a plurality of uprights mounted to the lower frame assembly, a bracing assembly and an elevator assembly. The plurality of uprights comprises at least one left upright structure and at least one right upright structure. The elevator assembly is mounted via lift brackets and via the stabilization brackets to the plurality of uprights of said upper frame assembly, wherein the elevator assembly comprises at least a left lift and stabilization track and a right lift and stabilization track, or alternatively, might comprise at least one center stabilization track and a left lift track and a right lift track. Note that in either case, and regardless of the respective terminology employed thereof, the "lift" and "stabilization" features operate in a cooperative fashion, even if they are physically distinct or structured when provided in the inventive device. Nevertheless, for the initial embodiment broadly described above, the left lift and stabilization track is affixed to the left upright structure via at least one of the lift brackets and the stabilization brackets, and the left lift and stabilization track includes a left stabilization rod for vertical sliding engagement with at least one stabilization bracket through a vertical longitudinal guide hole provided within the at least one stabilization bracket. The left stabilization rod is further provided with a left stabilization rod top end connector. The left lift and stabilization track further includes a left lift rod cooperatively engaged in a vertical orientation with a left gas spring for elevation and lowering of the left lift rod by the left gas spring, wherein the left gas spring is vertically affixed to at least one lift bracket, the left lift rod being further provided with a left lift rod top end connector. The right lift and stabilization track is affixed to the right upright structure via at least one of the lift brackets and said stabilization brackets. The right lift and stabilization track includes a right stabilization rod for vertical sliding engagement with at least one stabilization bracket through a vertical longitudinal guide hole provided within at least one stabilization bracket. The right stabilization rod is further provided with a right stabilization rod top end connector. The right lift and stabilization track further includes a right lift rod cooperatively engaged in a vertical orientation with a right gas spring for elevation and lowering of the right lift rod by the right gas spring, the right gas spring being vertically affixed to at least one lift bracket. The right lift rod is also further provided with a right lift rod top end connector. The bracing assembly is horizontally situated and affixed on a left side to the left stabilization rod top end connector and to the left lift rod top end connector, and is likewise horizontally situated and affixed on a right side to the right stabilization rod top end connector and to the right lift rod top end connector, and includes two handles mounted thereto so that the handles are positioned for assisting a user when walking and for assisting the user in rising from a seated position. Also included is a remote activation mechanism for simultaneously controlling the elevation and the lowering of both of the left lift rod and the right lift rod in a synchronized fashion, thereby effectuating a horizontally aligned elevating and lowering of the bracing assembly via a coordinated activation of the left gas spring and right gas spring. The activation assembly is capable of controlling the elevation and the lowering of both of the left lift rod and the right lift rod, all of which can be done at variable heights relative to said lower frame assembly. The inventive lift walker further provides for the lower frame assembly to comprise anti-tip features such as a widened lower frame assembly profile and/or a plurality of anti-tip wheels with optional shock absorbance.

Figure 13:
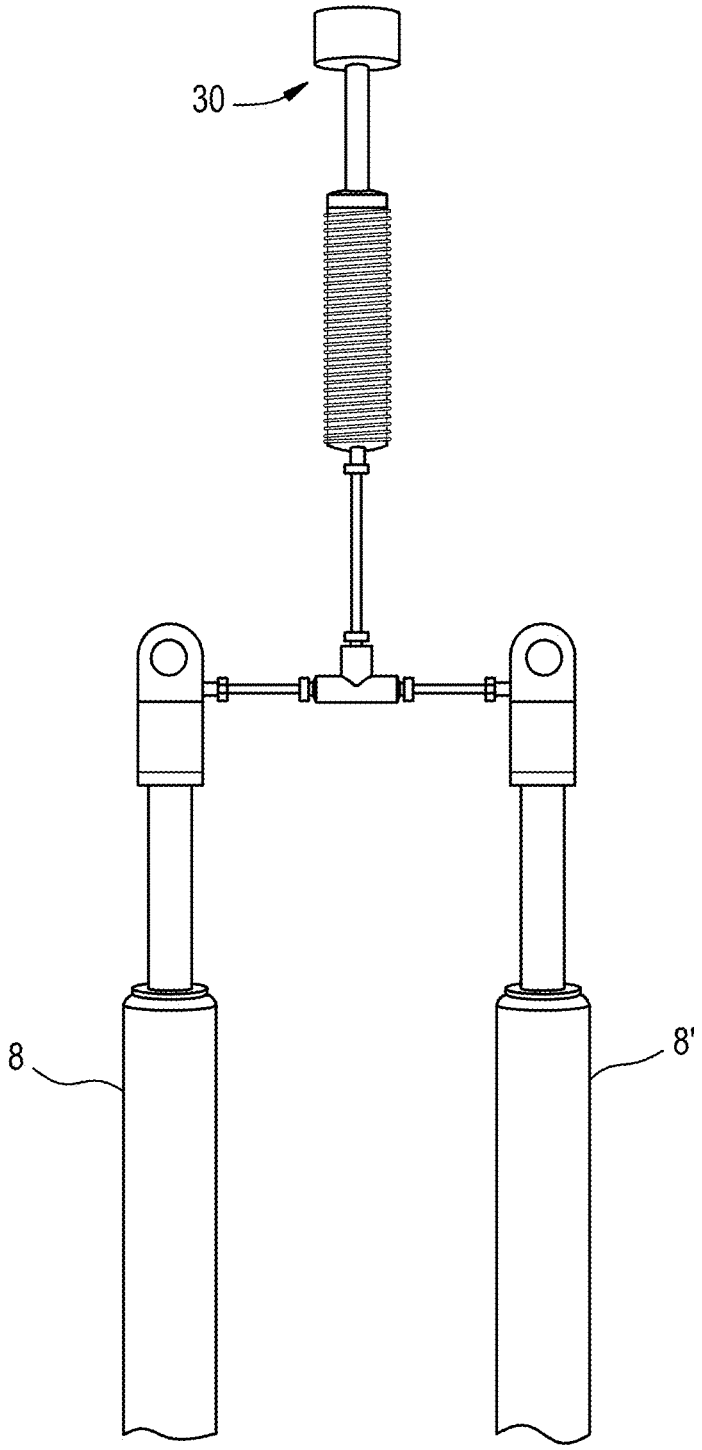
FIG. 13 is an illustrative depiction of an activation assembly that might be employed within the inventive device of FIG. 1.

Thus, when provided in accordance with the above, the present invention therefore provides an ambulatory assist device or "lift walker," having an elevator assembly that raises and lowers a bracing assembly that cooperatively assists the user in rising from a seated to a standing position. Referring now to the embodiment shown in FIG. 1, with cross-reference to alternative perspective views FIGS. 2-10 of the drawings, there is illustrated inventive device 2 comprising a frame assembly 4 having: a lower frame assembly 5 adapted to contact the ground through anti-tip wheels 24 at a front 9 of lower frame assembly 5 and rear skid poles 22; an upper frame assembly 17 vertically affixed to lower frame assembly 5; the upper frame assembly comprising a plurality of uprights 19, including at least one left upright structure 31 on left side 13 and at least one right upright structure 33 on right side 15, mounted to lower frame assembly 5; an elevator assembly 23; bracing assembly 20; and activation assembly 30 (further detailed specifically in FIG. 13). To minimize weight and enhance modularity, in one embodiment, frame assembly 4 might be constructed from say, 1-inch outer diameter aluminum piping with say, an illustrative 0.113 inch wall thickness or the like, and may be connected by exemplary structural fittings (not specifically depicted) such as elbows or tees. Adjacent pipe lengths might be placed in such fittings and secured using set screws tightened on flattened sections of pipe. Regardless of the illustrative modularity, the following text describes in greater detail each of the aforementioned components of the inventive lift walker.

Elevator assembly 23 is mounted via lift brackets 6, 6' and via the stabilization brackets 27, 27' to plurality of uprights 19 (including at least left upright structure 31 and at least right upright structure 33) of said upper frame assembly 17. Elevator assembly 23 comprises at least a left lift and stabilization track (comprising at least left stabilization rod 10 and left lift rod 16) and a right lift and stabilization track (comprising right stabilization rod 10' and right lift rod 16'). The left lift and stabilization track is affixed to left upright structure 31 via at least one of the lift brackets and said stabilization brackets (comprising at least one lift bracket 6 and stabilization bracket 27), and similarly, the right lift and stabilization track is affixed to right upright structure 33 via at least one of the lift brackets and said stabilization brackets (comprising at least one lift bracket 6' and stabilization bracket 27'). Both sets of lift brackets 6, 6' and said stabilization brackets 27, 27', respectively on left side 13 and right side 15 may further stabilize their affixment to plurality of uprights 19 through optional provision of left cross bracket 18 and right cross bracket 18'. It is noted that usage of left cross bracket 18 and right cross bracket 18' can serve several purposes: (i) left cross bracket 18 and right cross bracket 18' can serve as a mounting surface for stabilization brackets 27, 27' to plurality of uprights 19; (ii) left cross bracket 18 and right cross bracket 18' can serve as a mounting surface for lift brackets 6, 6' to plurality of uprights 19, (iii) left cross bracket 18 and right cross bracket 18' can stabilize frame assembly 4, especially when under high dynamic loads experienced during user weight support; and (iv) left cross bracket 18 and right cross bracket 18' can serve as central, bilaterally disposed anchor points that allow for the precise placement of elevator assembly 23 frame assembly 4, thereby enabling elevator assembly 23 (and consequently bracing assembly 20) to move vertically through the specified range of motion without uneven positioning. Both the left lift and stabilization track and the right lift and stabilization track include, respectively, aforementioned left stabilization rod 10, right stabilization rod 10' for vertical sliding engagement with aforementioned stabilization brackets 27, 27' through vertical longitudinal guide holes 35, 35' with associated self aligning linear ball bearing sleeves 40 provided within each respective stabilization bracket 27, 27'. Each respective stabilization rod 10, 10' is further provided with a stabilization rod top end connector 34, 34'. Each respective lift and stabilization track further includes lift rods 16, 16' cooperatively engaged in a vertical orientation with a respective gas spring 8, 8' for elevation and lowering of respective lift rods 16, 16' by respective gas springs 8, 8'. To this end, each gas spring 8, 8' is vertically affixed to at least one respective lift bracket 6, 6' and normally includes lift rods 16, 16' as an integral or included part thereof, such that the gas contained within each gas spring 8, 8' pushes the respective lift rods 16, 16' upward to provide elevation, with lowering of the same being effectuated through a user's body weight which pushes each respective lift rod 16, 16' downward within the gas therein to return the same within a housing of gas springs 8, 8'. Each lift rod 16, 16' is further provided with a respective lift rod top end connector 14, 14'. In some embodiments, respective lift rod top end connectors 14, 14' and stabilization rod top end connector 34, 34' may be integrated into a consolidated structure that permits both respective lift rods 16, 16 and stabilization rod 10, 10' to be affixed to a common attachment means. In one alternative embodiment, it is also possible to employ a total of four gas springs 8, 8' (e.g., two per side) rather than the above-described total of two gas springs 8, 8' (e.g., one per side), in order that gas springs 8, 8' with lower force outputs for each can be used. Note that in yet a further alternative embodiment, elevator assembly 23 might instead comprise at least one "central" stabilization track (not shown) that is centered on say, upper frame assembly 17 towards a front 9 of inventive device 2, instead of the above described provision of a separate left lift track and a separate right lift track. However, in such an alternative embodiment, a similar constant vertical positioning as described herein might still be afforded, albeit with a different structure as it pertains to provision of a centralized, unified stabilization track and/or lifting track that may be affixed to a centralized upright structure that is formed from the plurality of uprights 19.

Bracing assembly 20 is illustratively formed in one embodiment depicted herein, as horizontally situated, weight bearing forearm pads for the bracing and supportive resting of a user's forearms during use, and therefore avoids the need for handle gripping and the use of user retention harnesses. Bracing assembly 20 may also include two optional handles 21 vertically affixed, or otherwise mounted thereto, so that the handles are positioned for assisting a user when walking, for assisting the user in rising from a seated position, and for assisting the user in returning to a seated position from standing. It is important that bracing assembly 20 be maintained parallel (horizontal) to the ground as elevator assembly 23 is raised and lowered by a user. It is especially important that this be done in a cooperative or coordinated fashion on both left side 13 and right side 15 so that the user does not experience any destabilization from uneven adjustments from either side during the raising or lowering thereof. This is achieved as specifically shown in FIGS. 1 and 7-9 by providing the aforementioned left lift and stabilization track and right lift and stabilization track in cooperation with the activation assembly 30, described hereafter, together with respective lift brackets 6, 6' and their respective variable point mechanisms 42 for connecting of gas springs 8, 8', and self-aligning linear ball bearing sleeves 40 disposed within vertical longitudinal guide hole 35, 35'.

Figure 12:
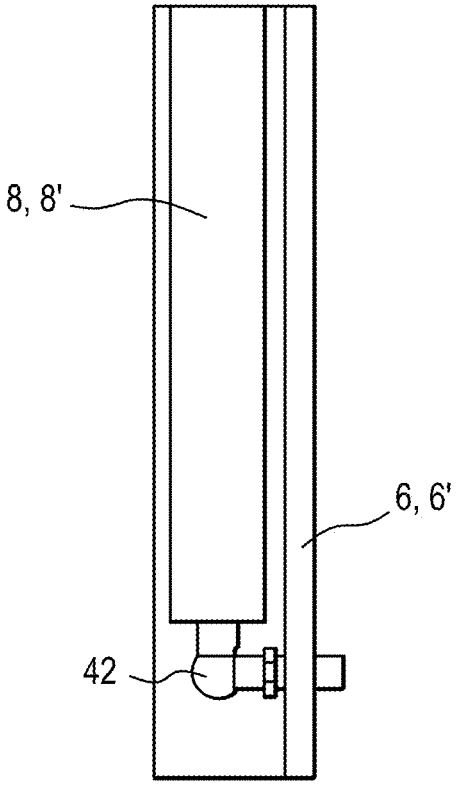
FIG. 12 is an illustrative depiction of an illustrative ball headed bolt and nut (rod end assembly) that might be utilized within the variable point mechanism to connect the gas spring to connect the gas spring within of the inventive device of FIG. 1.

As mentioned above, inventive lift walker 2 offers an essentially consistent force output through the entire range of (purely vertical) motion, without the disadvantages of rotary motion towards the user, and without the use of powered systems involving batteries and the like. In effectuating this, remote release gas springs, such as those illustratively available from Bansbach Easylift of Melbourne, Fla. might be chosen for gas springs 8, 8', given that such devices are provide adjustable force values, wide ranges of motion, and variable sizes, and because such gas springs, unlike their mechanical counterparts, provide near constant force output through the entire range of motion. In order to further provide the aforementioned consistent force output, other components are further needed, namely a combination of respective variable point mechanisms 42 with gas springs 8, 8', and self-aligning linear ball bearing sleeves 40, disposed within vertical longitudinal guide hole 35, 35', all of which can augment and improve the required constancy of the desired range of motion. As generally depicted in FIG. 1, and as more particularly shown in FIGS. 7-9, gas springs 8, 8' are attached bilaterally to the inventive walker frame through respective lift brackets 6, 6' in order to effectuate the lifting of elevator assembly 2, and thereby cooperatively provide for a balanced lift assist of a user's weight. To achieve the desired range of motion therein, lift brackets 6, 6' are designed, in one embodiment, to offset the use and attachment of respective variable point mechanisms 42, and also, so as to shield the user from the moving parts of gas springs 8, 8'. It is noted that variable point mechanisms 42 can thusly function as the point of affixment to lift brackets 6, 6' and can be illustratively provided, in one embodiment, as a ball-socket rod end (e.g., a ball-joint fitting with a socket/rod-end assembly on gas springs 8, 8', depicted as 42 in FIG. 12) which can compensate for misalignment via what is essentially a universal style connector that permits 360 degrees of rotation in order to offer the advantage of compensation for any potential load misalignment. Specifically as depicted in FIG. 12, a ball stud fits into a respective socket of gas springs, 8, 8' thereby making up the ball-joint fitting of variable point mechanisms 42 in this illustrative embodiment. The specific location of the attachment points of the ball-socket rod ends (variable point mechanisms 42) can be made adjustable because the ball-socket rod end is attached to gas springs 8, 8' such that the ball stud (which itself remains stationary and fixed as described) permits the ball-socket rod end to swivel (rotate in any direction) so as to compensate for misalignment when mounted to respective lift brackets 6, 6' via a threaded connection. Further to this point, it is similarly noted that the upper or top connection on gas springs 8, 8' (e.g., connection to bracing assembly 20 via respective lift rod top end connectors 14, 14') can also adjust to compensate for misalignment, albeit via a simple pivot (rotary joint) at the top which permits the top to rotate just in the plane of bracing assembly 20. When provided as such, both the top and bottom attachment means for gas springs 8, 8' (e.g., respectively, connection to bracing assembly 20 via respective lift rod top end connectors 14, 14', and the affixment of the bottom of gas springs 8, 8' to lift brackets 6, 6' via variable point mechanisms 42) can therefore be made adjustable in order to cooperatively compensate for any misalignment.

Additionally, variable point mechanisms 42 can be used (in addition to adjustment of the gross lifting force of gas springs 8, 8' based upon a user's weight and height, as described hereafter) to control the amount of vertical force for therapy situations on demand. More specifically, provision is made for offsetting of attachment mechanisms 42 so as to provide adjustment of the angle of gas springs 8, 8', noting that if the orientation of the gas spring is not exactly parallel to the stabilization track, then the resultant lift force will be less than the full force of the gas springs. Adjustment of such means that the same will be scaled by the cosine of the angle of the gas spring with the vertical axis of the lift walker (lift force=gas spring force×cosine (angle with vertical)), such that if the angle were say, 30 degrees, then the lift force would be 0.87 the rating of the gas spring, or if it were 45 degrees then the lift force would be 0.707 the rating of the gas spring, or if it were 60 degrees then the lift force would be 0.5 the rating of the gas spring, and so forth. Adjustment of the same can therefore decrease the lift force and allow for finer adjustments in the field of use by a user, as opposed to the more specialized adjustment made by a technician actual adjustment of gas springs 8, 8'. Nevertheless, in some embodiments, it may be preferable not to adjust the gas springs in such a fashion where one bleeds pressure out of gas springs 8, 8' in order to reduce the force, given that there is no easy way to then increase the force as needed thereafter, short of installing new gas springs 8, 8'.

Vertical motion of gas springs 8, 8' can be effectuated through activation assembly 30, which, in one embodiment, comprises a hydraulic push button release system, allowing the release of both gas springs with the push of one button. Gas springs 8, 8' are configured so they lock in place at all times when the push button is not compressed. When desired, the user pushes the release button in and the gas springs extend, thereby raising elevator assembly 23 with bracing assembly 20 as well as the user's weight as applied through the resting of user forearms on bracing assembly 20. Once upright, the button is released to lock the springs, and the walker is capable of supporting the full body weight, if needed. To sit, the user simply pushes the button and uses his body weight to compress the cylinders. Extension of gas springs 8, 8' provides for a vertical force of (up to) a certain customized percentage of the user's body weight to assist in standing. Provision of such is deemed especially advantageous to users who have spinal cord injury, as such persons often lack hand function to grip handles or bars to maintain coupling with a walker platform. In any case, it is noted that the system may therefore be custom configured to support virtually any percentage of a user's body weight, but in practical applications one illustrative approximation of 80% can be deemed a desirable percentage of body weight support because it provides significant lifting assistance for the sit-to-stand transition, while still allowing the user's full body weight to be sufficient to lower the mechanism during the stand-to-sit transition. However, it is generally undesirable to provide 100% or greater percentage of a user's body weight for assistance, because this would make independent lowering of bracing assembly 20 impossible given that a user would need assistance to push down on bracing assembly 20 in order to compress the gas springs 8, 8'. Thus, in some embodiments, gas springs 8, 8' would be set to percentage of a user's body weight that could be 75% or less for relatively stronger or mobile users, while values of 80% to less that 100% might be a setting for persons who are weak or paralyzed. Typically, when effectuating such customized configuration of the vertical force as a percentage of a user's body weight, one might modify the lifting force of gas springs 8, 8' through the following steps of: (i) measuring 100% of a user's body weight and scaling it to one of the above referenced percentages (e.g., 80%, 75%, etc.) based upon the specific nature of physical disability; (ii) dividing the resulting value by the number of gas springs 8, 8' (e.g., if there are two springs, then this value must then be cut in half to select the appropriate maximum spring strength, or alternatively, a technician could bleed some pressure out of adjustable gas springs 8, 8' to get to the resulting illustrative 40% body weight for each gas spring 8, 8'); (iii) assessing whether the settings are correct, noting that incorrect settings will result in the user needing third party assistance to push down on bracing assembly 20 when attempting to compress the gas springs 8, or where the user has trouble sitting down; (iv) adjusting the settings, if needed, by changing the angle of gas springs 8, 8' with the aforementioned vertical axis of lift walker 2 by moving the points of the connection to bracing assembly 20 at the respective lift rod top end connectors 14, 14' forward or backward, so as to adjust the spring strength in order to provide less lifting force, as previously described above. It is noted that in providing step (iv) above, the present invention also contemplates an optional adjustment facilitator means which provides for the usage of a track or series of engageable holes in the connection to bracing assembly 20 at the respective lift rod top end connectors 14, 14' (not depicted) as means of facilitating such adjustments. In either case, when adjusted as needed, it is understood that the farther away from vertical that gas springs 8, 8' are situated (e.g., the farther forward or backward horizontally that the attachment point is from the original location), then the less lifting force provided. To this end, the user can try the device after each adjustment until comfortable with the amount of lifting assistance and until able to sit independently without third party help. By way of one illustration of such, the customized configuration of the vertical force is shown for an illustrative individual weighing approximately 225 lbs, for whom the vertical lift force and range of motion (e.g., vertical height adjustment) of the inventive lift walker might be customized according to the easily varied design specifications illustratively described in Table 1 below:

TABLE 1

Vertical Lift Assist Walker Design Specifications

| Criteria | Specification |
|---|---|
| Vertical lift force | 180 lbf. |
| Weight support capacity | 300 lbf. |
| Minimum platform height from floor | 34 inches |
| Maximum platform height from floor | 54 inches |
| Vertical range of motion | 20 inches |
| Width (inner frame) | 32 inches |
| Depth (front to back) | 40 inches |
| No anterior-posterior or medial-lateral platform motion | Provided |

Inventive device 2 further includes self-aligning linear bearing sleeves 40 or the like within vertical longitudinal guide holes 35, 35' of each respective stabilization bracket 27, 27'. Self-aligning linear bearing sleeves 40 will ideally allow up to 2° of shaft (e.g., alignment rods 10, 10') misalignment in any direction, and are virtually maintenance free when illustratively provided with a nonabrasive, chemical-resistant PTFE liner or the like that does not require added lubrication. In one illustrative embodiment, self-aligning linear bearing guide 40 may be provided as self-aligning linear bearing sleeves 40, which is inserted within vertical longitudinal guide hole 35, 35'. Alternatively, self-aligning linear bearing sleeves 40 can be inserted in, or included within, a ready-made aluminum pillow block in order to form the overall structure of each respective stabilization bracket 27, 27'. Either of these variants is available commercially from suppliers such as McMaster-Carr of Robbinsville, N.J. When these variants of self-aligning linear bearing guide 40 are used, left stabilization rod 10 and right stabilization rod 10' may be provided as hardened shafts made of steel, chrome-plated steel, or stainless steel with a hardness of at least Rockwell C50 in order to ensure smooth engagement therewith. In any case, self-aligning linear bearing sleeves 40 are important to the cooperative, coordinated vertical movement of left stabilization rod 10 and right stabilization rod 10' and ensure that when elevator assembly 23 is raised or lowered, bracing assembly 20 always remains substantially parallel to the ground, without uneven height adjustments or lateral misalignments towards the sides, front or back of inventive device 2. This even alignment feature is further amplified when combined with the aforementioned variable point mechanisms 42 as provided on both sets of lift brackets 6, 6'.

The inventive system also has features which also make it advantageous for patients when compared with conventional walkers, in that it has anti-tip features such as an extended wheelbase and furthermore, the front casters or wheels are anti-tip front wheels 24 that are fitted with shocks or springs (not specifically depicted) that can attenuate sudden stoppage due to uneven travel surfaces, and which help avoid frontward stoppage that can tip the unit and possibly the user over the front end. Anti-tip wheels 24 may include shocks or springs that are available under the product names such as: TPR Shock Absorbing Caster Wheels from E.R. Wagner Manufacturing Co. of Hustisford, Wis.; Shock Absorbing Casters from The Hamilton Caster & Mfg. Co. of Hamilton, Ohio; or Omega wheels from Cisco-Eagle of Little Rock, Ark., and may be formed from many different shock attenuating tread materials such as phenolic and solid polyurethane and the like. Furthermore, it is noted that the point 23 where anti-tip wheels 24 are affixed to lower frame assembly 5 may also include yet additional anti-tip features termed horizontal lateral translational attenuators. These horizontal lateral translational attenuators may be formed from the use of slip joints (not specifically depicted) or the like. The function of these horizontal lateral translational attenuators is to further lessen the direct transmission of shocks that occur during sudden blockage from uneven round surface areas, especially when compared with conventional approaches to affixing standard wheels that are simply attached by screws, bolts, rivets, or welds. Provision of the illustrative slip joints may be further augmented with horizontally disposed springs if required, but in either case, would ideally offer a translation of the joint along horizontal lateral axis 27 as a means of providing additional attenuation from the aforementioned shocks.

To this end, the present invention overcomes the aforementioned and other disadvantages inherent in the prior art. As a consequence, the lift of this invention is extremely versatile. It can be used to assist persons who have some use of their legs but insufficient strength to give full support to the weight of the body. While several aspects of the present invention have been described and depicted herein, alternative aspects may be implemented by those skilled in the art to accomplish the same objectives. Accordingly, it is intended by the appended claims to cover all such alternative aspects as fall within the true spirit and scope of the invention.

We claim:

1. A lift walker comprising:

a frame assembly having:

a lower frame assembly adapted to contact the ground;

an upper frame assembly vertically affixed to said lower frame assembly;

said upper frame assembly comprising a plurality of uprights mounted to the lower frame assembly, the plurality of uprights comprising at least one left upright structure and at least one right upright structure;

an elevator assembly mounted via lift brackets and via stabilization brackets to said plurality of uprights of said upper frame assembly, said elevator assembly comprising a left lift and stabilization track and a right lift and stabilization track;

said left lift and stabilization track being affixed to said left upright structure via at least one left lift bracket and via at least one left stabilization bracket, said left lift and stabilization track including:

a left stabilization rod for vertical sliding engagement with at least one said stabilization bracket through a vertical longitudinal guide hole provided within said at least one left stabilization bracket, said left stabilization rod being further provided with a left stabilization rod top end connector;

said left lift and stabilization track further including a left lift rod cooperatively engaged in a vertical orientation with a left gas spring for elevation and lowering of the left lift rod by said left gas spring, said left gas spring being vertically affixed to said at least one left lift bracket, said left lift rod being further provided with a left lift rod top end connector;

said right lift and stabilization track being affixed to said right upright structure via at least one right lift bracket and via at least one right stabilization bracket, said right lift and stabilization track including:

a right stabilization rod for vertical sliding engagement with at least one said stabilization bracket through a vertical longitudinal guide hole provided within said at least one right stabilization bracket, said right stabilization rod being further provided with a right stabilization rod top end connector;

said right lift and stabilization track further including a right lift rod cooperatively engaged in a vertical orientation with a right gas spring for elevation and lowering of said right lift rod by said right gas spring, said right gas spring being vertically affixed to at least one said right lift bracket, said right lift rod being further provided with a right lift rod top end connector;

a bracing assembly, said bracing assembly being horizontally situated and affixed on a left side to said left stabilization rod top end connector and to said left lift rod top end connector, said bracing assembly further being horizontally situated and affixed on a right side to said right stabilization rod top end connector and to said right lift rod top end connector;

said bracing assembly including two handles mounted thereto, said two handles positioned for assisting a user when walking and for assisting the user in rising from a seated position; and a non-electric powered activation mechanism for simultaneously controlling said elevation and said lowering of both of said left lift rod and said right lift rod in a synchronized fashion, thereby effectuating a horizontally aligned elevating and lowering of said bracing assembly via a coordinated activation of said left gas spring and said right gas spring, wherein said left gas spring and said right gas spring include angle adjustment custom configuration of lifting support.

2. The walker as recited in claim 1, wherein self-aligning linear bearing sleeves are contained within said vertical longitudinal guide hole of said at least one stabilization bracket in said left lift and stabilization track and said vertical longitudinal guide hole of said at least one stabilization bracket in right lift and stabilization track.

3. The walker as recited in claim 2, wherein said activation mechanism is capable of controlling said elevation and said lowering of both of said left lift rod, said right lift rod, and said bracing assembly at variable heights relative to said lower frame assembly.

4. The walker as recited in claim 3, wherein said left gas spring and said right gas spring can be adjusted through an adjustment facilitator.

5. The walker as recited in claim 3, wherein said left gas spring is affixed to said at least one left lift bracket with a variable point mechanism, and wherein said right gas spring is affixed to said at least one right lift bracket with a separate a variable point mechanism.

6. A lift walker comprising:

a frame assembly having:

a lower frame assembly adapted to contact the ground;

an upper frame assembly vertically affixed to said lower frame assembly;

said upper frame assembly comprising a plurality of uprights mounted to the lower frame assembly, the plurality of uprights comprising at least one centralized upright structure;

an elevator assembly mounted via central lift and central stabilization brackets to said plurality of uprights of said upper frame assembly, said elevator assembly comprising a central lift and stabilization track;

said central lift and stabilization track including:

at least one central stabilization rod for vertical sliding engagement with at least one said central stabilization bracket through a vertical longitudinal guide hole provided within said at least one central stabilization bracket, said central stabilization rod being further provided with a central stabilization rod top end connector;

said central lift and stabilization track further including at least one central lift rod cooperatively engaged in a vertical orientation with at least one central gas spring for elevation and lowering of the central lift rod by said at least one central gas spring, said at least one central gas spring being vertically affixed to said at least one central lift bracket, said central lift rod being further provided with at least one central lift rod top end connector;

a bracing assembly, said bracing assembly being horizontally situated and affixed to said central stabilization rod top end connector and to said central lift rod top end connector;

said bracing assembly including two handles mounted thereto, said two handles positioned for assisting a user when walking and for assisting the user in rising from a seated position; and a non-electric powered activation mechanism for simultaneously controlling said elevation and said lowering of said at least one central lift rod in a consistent fashion, thereby effectuating a horizontally aligned elevating and lowering of said bracing assembly, wherein said at least one central gas spring includes angle adjustment custom configuration of lifting support.

7. The walker as recited in claim 6, wherein self-aligning linear bearing sleeves are contained within said vertical longitudinal guide hole of said at least one stabilization bracket in said central lift.

8. The walker as recited in claim 7, wherein said activation mechanism is capable of controlling said elevation and said lowering of said at least central lift rod and said bracing assembly at variable heights relative to said lower frame assembly.

9. The walker as recited in claim 8, wherein said at least one central gas spring can be adjusted through an adjustment facilitator.

10. The walker as recited in claim 9, wherein said at least one central gas spring is affixed to said at least one central lift bracket with a variable point mechanism.

* * * * *